US007066001B2

(12) United States Patent
Pitkanen et al.

(10) Patent No.: US 7,066,001 B2
(45) Date of Patent: Jun. 27, 2006

(54) DEVICE FOR MACHINING BAND-LIKE OR PLATE-LIKE MATERIAL

(75) Inventors: Veikko Pitkanen, Hyvinkaa (FI); Heikki Saariluoma, Hyvinkaa (FI); Ari Maenpaa, Jokela (FI)

(73) Assignee: Pivatic Oy (FI)

( * ) Notice: Subject to any disclaimer, the term of this patent is extended or adjusted under 35 U.S.C. 154(b) by 398 days.

(21) Appl. No.: 10/416,034

(22) PCT Filed: Nov. 7, 2001

(86) PCT No.: PCT/FI01/00965

§ 371 (c)(1),
(2), (4) Date: Sep. 4, 2003

(87) PCT Pub. No.: WO02/38300

PCT Pub. Date: May 16, 2002

(65) Prior Publication Data

US 2004/0031368 A1 Feb. 19, 2004

(30) Foreign Application Priority Data

Nov. 10, 2000 (FI) ..... 20002468

(51) Int. Cl.
*B21D 28/02* (2006.01)
*B26F 1/04* (2006.01)

(52) U.S. Cl. ..... 72/442; 72/446; 83/409; 83/549

(58) Field of Classification Search ..... 72/442, 72/446, 472; 83/409, 549, 552
See application file for complete search history.

(56) References Cited

U.S. PATENT DOCUMENTS

| | | | | | |
|---|---|---|---|---|---|
| 3,895,550 | A * | 7/1975 | Daniels | 83/409 |
| 4,510,789 | A * | 4/1985 | Tomioka et al. | 72/442 |
| 4,532,843 | A | 8/1985 | Miyama | |
| 4,708,042 | A * | 11/1987 | Jung | 83/549 |
| 5,119,666 | A * | 6/1992 | Fujiwara | 72/442 |
| 5,184,498 | A * | 2/1993 | Hayashi | 72/442 |
| 5,346,454 | A * | 9/1994 | Hayashi | 72/446 |

FOREIGN PATENT DOCUMENTS

| | | |
|---|---|---|
| EP | 0 418 114 | 8/1990 |
| FR | 2 540 422 | 2/1983 |

* cited by examiner

*Primary Examiner*—David Jones
(74) *Attorney, Agent, or Firm*—Dickstein, Shapiro, Morin & Oshinsky, LLP.

(57) ABSTRACT

The invention relates to a device for machining band-like or plate-like material (1), especially for punching, notching and forming it, the device comprising the body (2) of the device, at least one tool holder (3), most preferably a gap frame tool holder, between the upper branch (4) and lower branch (5) of which the material (1) to be processed is arranged to be fed, and to the upper branch (4) of which tool holder (3) is connected an upper tool magazine (6) comprising a plurality of upper tools (8), and to the lower branch (5) of which tool holder (3) is connected a lower tool magazine (7) comprising lower tools (9) corresponding to the said upper tools (8), a support means (10) for supporting the tool holder (3) movably on the body (2) of the device, a transfer means (11) for positioning the tool holder (3) in a transverse direction (B) with respect to the direction of feed (A) of the material (1) to be processed, and a power means (12) for effecting the machining movement for the tool comprised of the upper tool (8) and the lower tool (9), which is in the tool holder (3). A joint buffer disc (13) for directing the machining force is provided for the tool holders (3) comprised in the device, the buffer disc being moved by the said power means (12). Between the buffer disc (12) and the upper tool magazine (6) is arranged a movable spacer (14) for directing the force via the said spacer (14) at an individual upper tool (8) in the upper tool magazine (6).

5 Claims, 2 Drawing Sheets

DEVICE FOR MACHINING BAND-LIKE OR PLATE-LIKE MATERIAL

The invention relates to a device for machining band-like or plate-like material, especially for punching, notching and forming it, the device comprising the body of the device, at least one tool holder, most preferably a gap frame tool holder, between the upper and lower branches of which the material to be machined is arranged to be fed, and to the upper branch of which tool holder is connected an upper tool magazine comprising a plurality of upper tools, and to the lower branch of which tool holder is connected a lower tool magazine comprising lower tools corresponding to the said upper tools, a support means for supporting the tool holder movably on the body of the device, a transfer means for positioning the tool holder in a transverse direction with respect to the direction of feed of the material to be processed, and a power means for effecting the machining movement for the tool comprised of the upper tool and the lower tool, which is in the tool holder.

In an earlier device of this type invented by the applicant and representing the prior art, a hydraulic power means is provided for each individual tool in the tool magazine. The operation of a selected tool is started by activating the power means located by the tool in question. The power means and the tool holder are connected to a joint support means, which can in turn be moved with respect to the material to be processed, in order to make a hole or the like at a desired point.

The aim of the invention is to simplify the known device and to provide more wide-ranging possibilities for fitting tools in the tool magazine and for replacing the tool magazines. A further aim of the invention is to keep the device as narrow as possible, when viewed in the direction of feed of the material.

This aim is achieved by means of a device, which is characterized in that a joint buffer disc for directing the machining force is provided for the tool holders comprised in the device, the buffer disc being moved by the said power means, and that between the buffer disc and the upper tool magazine is arranged a movable spacer for directing the force via the said spacer at an individual upper tool in the upper tool magazine. A programmable transfer apparatus is preferably arranged for moving of the spacer.

In order to simplify the transfer apparatus, a preferable arrangement is such that the transfer apparatus and the tool holder are connected to a joint support means, which is supported movably on the body of the device.

In order to make the transfer apparatus as narrow as possible in the direction of feed of the material, the arrangement in one preferred embodiment of the invention is such that the transfer apparatus comprises a part effecting linear motion and a part effecting rotational motion. In such a case, the most preferable arrangement is such that the part effecting linear motion and the part effecting rotational motion are arranged to rotate together with respect to the body of the device.

For each tool holder is provided its own spacer. In this way, any tool in the tool holder can be activated by moving the spacer to the tool in question.

A particularly advantageous arrangement is one where the device comprises two tool holders, in which case the tool holders are arranged on opposite sides of the material to be processed.

The invention is described in greater detail in the following, with reference to the accompanying drawings, in which FIG. 1 shows the device relating to the invention as a diagrammatic side view.

Figure 1:
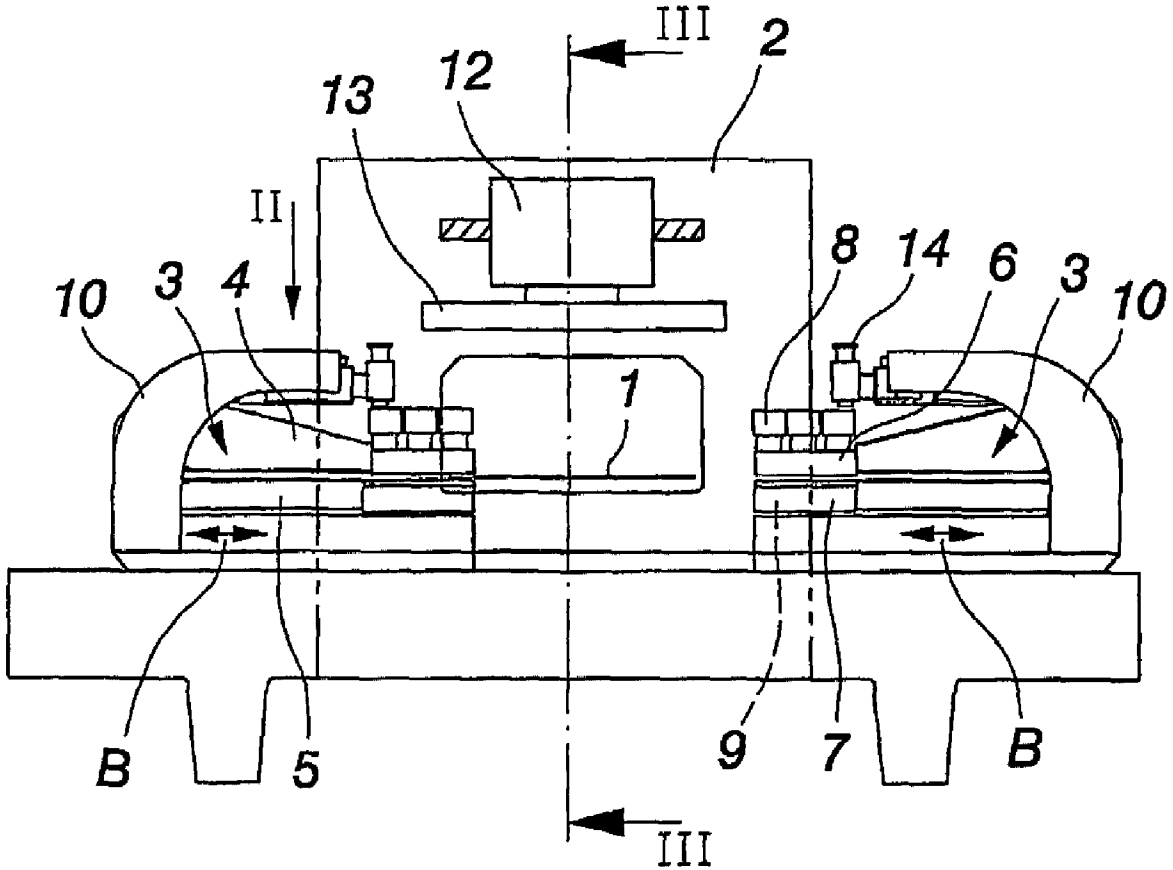

FIG. 1 shows diagrammatically a device for machining band-like or plate-like material 1, for example, steel plate. The device is intended especially for punching, notching and forming the material 1. The device may operate as an independent device or as a part of a more extensive production line.

Figure 2:
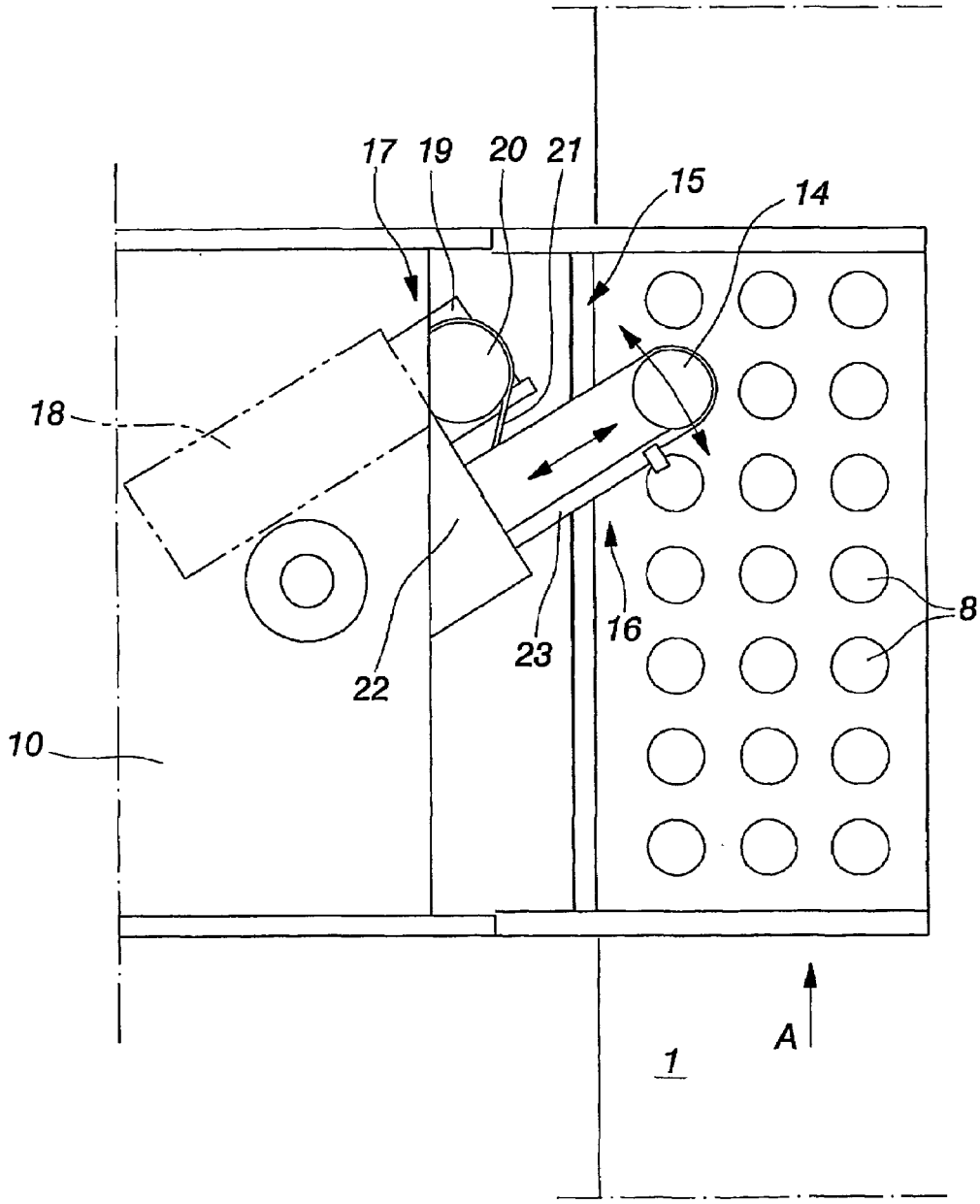
FIG. 2 shows a top view of the device relating to the invention at the location of arrow II in FIG. 1.

The device comprises a body, marked generally with reference numeral 2, and a feeding means (not shown) for feeding the material 1 to be processed periodically with respect to the body 2, in the direction of arrow A (FIG. 2).

The material 1 to be processed is arranged to be fed between the upper branch 4 and the lower branch 5 of the tool holder 3, in FIG. 1 a gap frame tool holder. In the upper branch 4 of the tool holder 3 is incorporated an upper tool magazine 6, which comprises a plurality of upper tools 8. In the lower branch 5 of the tool holder 3 is incorporated a corresponding lower tool set 7, which comprises lower tools 9 corresponding to the said upper tools 8. The upper and lower tool magazines 6, 7 with their tools 8, 9 can be easily replaced, if necessary.

The device comprises most preferably two tool holders 3 which are arranged on opposite sides of the material 1 to be processed, as shown in FIG. 1.

Figure 3:
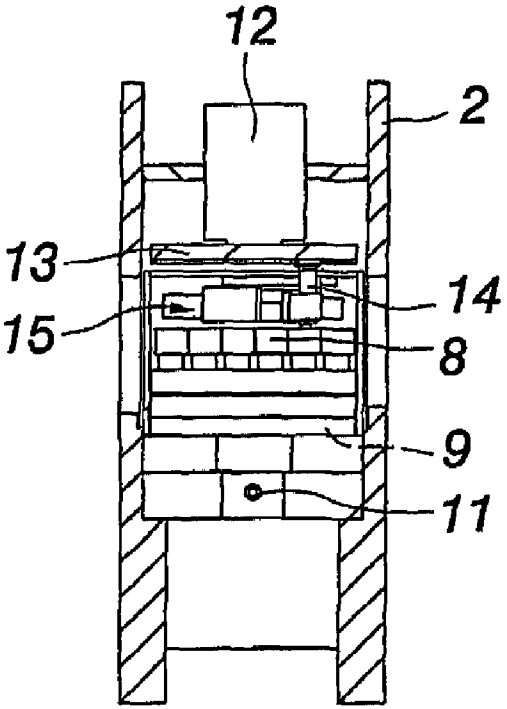
FIG. 3 shows a section along line III—III in FIG. 1.

The tool holder 3 is supported movably on the body 2 of the device by means of the support means 10 shown in FIGS. 1 and 3. The tool holder 3 can be easily detached from the support means 10 and replaced by another tool holder 3.

For each unit formed by a tool holder 3 and a support means 10 is arranged a transfer means 11 for positioning the tool holder in a transverse direction B with respect to the direction of feed A of the material to be processed. The transfer means 11 may be, for example, a ball nut/screw combination.

In the body 2 of the device is incorporated a power means 12 for effecting the machining movement for the tool comprised of the upper tool 8 and the lower tool 9 which is in the tool holder 3. The power means 12 may be, for example, a hydraulic cylinder or a link mechanism, which directs the machining force to the tool via the buffer disc 13.

A joint buffer disc 13 for directing the machining force is provided for the tool holders 3 comprised in the device, the buffer disc being moved by the said power means 12. Between the buffer disc 13 and the upper tool magazine 6 is arranged a movable spacer 14 for directing the force via the said spacer 14 to an individual upper tool 8 in the upper tool magazine 6. The force will thus be transmitted from the buffer disc 13 to an individual upper tool 8 only when the spacer 14 is between the buffer disc 13 and the said individual upper tool. The spacer 14 may be comprised of any sufficiently strong piece by means of which the compressive force can be transmitted. For each tool holder 3 is arranged its own spacer 14.

A programmable transfer apparatus 15 is provided for moving the spacer 14. The transfer apparatus 15 and the tool holder 3 are connected to a joint support means 10 which is, in turn, supported movably on the body 2 of the device.

In the example shown in the drawing, the transfer apparatus 15 comprises a part 16 effecting linear motion and a part 17 effecting rotational motion, as appears best from FIG. 2.

The part 16 effecting linear motion and the part 17 effecting rotational motion are arranged to rotate together with respect to the body 2 of the device. In the example shown in FIG. 2, this has been implemented in such a way that the part 17 effecting revolving movement is formed by a motor 18, which rotates a belt pulley 20 by means of a gear 19. The belt pulley 20 in turn moves a belt 21, which is arranged to run via a stationary (=non-rotating) belt pulley (not shown) arranged on the support means 10, whereby rotating the belt pulley 20 causes the entire transfer apparatus 15 to rotate with respect to the support means 10. The motor 18, the gear 19 and the belt pulley 20 thus move with the support means 10.

The part 16 effecting linear motion may be implemented by means of a linear motor, which consists of a primary part 22 and a secondary part 23. The linear motion may obviously also be realized by means of, for example, a screw and nut drive.

The device functions in the following manner.

The power and movement from the power means 12 are transmitted to the tool 8 by means of the spacer 14. The spacer 14 is moved by means of the transfer apparatus programmatically to the tool 8 selected each time. When the buffer disc 13 moves, the material 1 being processed remains between the upper tool 8 and the lower tool 9, whereby a hole is perforated in the material 1, or a notch is made in it, or it is formed in accordance with the shape of the tools 8, 9.

The buffer disc 13 is returned by means of the power means 12 to its original position, whereby the cycle ends. When the buffer disc 13 is in its starting position, the tool holder 3 is moved by means of the transfer means 11 and the material to be processed is moved in direction A, so that the desired tool 8, 9 can be positioned in the desired position with respect to the material 1 to be processed. The transfer means 11 is fixed to the body 2 of the device as well as to the support means 10 in order to effect their mutual movement in direction B.

The device can be used in such a way that one tool is activated in both tool holders 3 simultaneously. It is, however, also possible to make such an arrangement that a tool in one tool holder 3 only will be activated, while the spacer 14 in the other tool holder 3 is positioned in such a way that it is not located by the tool.

The invention claimed is:

1. A device for machining band-like or plate-like material (1), especially for punching, notching and forming it, the device comprising:

the body (2) of the device, at least one tool holder (3), most preferably a gap frame tool holder, between an upper branch (4) and lower branch (5) of which the material (1) to be processed is arranged to be fed, and to the upper branch (4) of which tool holder (3) is connected an upper tool magazine (6) comprising a plurality of upper tools (8), and to the lower branch (5) of which tool holder (3) is connected a lower tool magazine (7) comprising lower tools (9) corresponding to the said upper tools (8), a support means (10) for supporting the tool holder (3) movably on the body (2) of the device, a transfer means (11) for positioning the tool holder (3) in a transverse direction (B) with respect to the direction of feed (A) of the material (1) to be processed, a power means (12) having a buffer disc (13) for effecting the machining movement for the tool comprised of the upper tool (8) and the lower tool (9), which is in the tool holder (3), between the buffer disc (13) and the upper tool magazine (6) is arranged a movable spacer (14) for directing the force via the said spacer (14) at an individual upper tool (8) in the upper tool magazine (6), and a programmable transfer apparatus (15) is provided for moving the spacer (14), characterized in that the transfer apparatus (15) and the tool holder (3) are connected to a joint support means (10) which is supported movably on the body (2) of the device that the transfer apparatus (15) comprises a part (16) effecting linear motion and a part (17) effecting rotational motion and that the part (16) effecting linear motion and the part (17) effecting rotational movement are arranged to rotate together with respect to the body (2) of the device.

2. A device as claimed in claim 1, characterized in that for each tool holder (3) is provided its own spacer (14).

3. A device as claimed in claim 1, characterized in that the device comprises two tool holders (3), and that the tool holders (3) are arranged on opposite sides of the material (1) to be processed.

4. A device as claimed in claim 1, characterized in that a joint buffer disc (13) for directing the machining force is provided for the tool holders (3) comprised in the device, the buffer disc being moved by the said power means (12).

5. A device as claimed in claim 1, characterized in that for each tool holder (3) is provided its own transfer apparatus (15).

* * * * *